United States Patent [19]

Oden et al.

[11] Patent Number: 4,866,805

[45] Date of Patent: Sep. 19, 1989

[54] SHOE SOLE CLEANER

[76] Inventors: Willie B. Oden; Virginia V. Oden, both of 135 Shoshane Trail, Toney, Ala. 35773

[21] Appl. No.: 215,778

[22] Filed: Jul. 5, 1988

[51] Int. Cl.[4] ..... A47L 23/22

[52] U.S. Cl. ..... 15/104.92; 15/161; 15/217

[58] Field of Search ..... 15/104.92, 161, 215, 15/216, 217

[56] References Cited

U.S. PATENT DOCUMENTS 3,696,459 10/1972 Kucera et al. ..... 15/104.92

3,911,520 10/1975 Tupper ..... 15/104.92

4,353,944 10/1982 Tarui ..... 15/217

4,425,677 1/1984 Cox ..... 15/104.92

4,520,525 6/1985 Yogi et al. ..... 15/104.92

4,793,018 12/1988 Ehrich ..... 15/104.92

*Primary Examiner*—Edward L. Roberts

[57] ABSTRACT

A shoe sole cleaner device comprising a bristle type mat structure positioned in a liquid-containment tray, with the bristles extending out of the cleaning liquid. A person can stand with both shoes on the mat structure; by shifting his shoes back and forth in a sliding motion he can achieve a liquid scrub action on the shoe soles.

3 Claims, 1 Drawing Sheet

SHOE SOLE CLEANER

BACKGROUND OF THE INVENTION

This invention relates to a cleaner device for removing dirt from the soles of a variety of shoes or boots. The device comprises a liquid-containment tray, and a bristle type mat structure supported in the tray with the bristle ends extending out of liquid in the tray. A person can stand on the mat structure while shifting his/her feet back and forth on the mat surface. A liquid-scrubbing effect is achieved to remove dirt from the sole areas of the person's shoes.

Our invention may be considered as an improvement on the device shown in U.S. Pat. No. 3,696,459 to A Kucera et al.

SUMMARY OF THE INVENTION

Our invention contemplates a low cost bristle type mat structure partially immersed in a contained body of cleaning liquid. The relatively stiff bristles can bend slightly as a person shifts his/her shoe back and forth along the bristle upper ends. Cleaning liquid is thereby applied to the shoe soles to effect a cleaning operation. The bristle type mat is readily removed from the liquid-containment tray when it is desired to remove accumulated soil from the tray. Our invention is viewed as a relatively low cost alternative to the system envisioned in U.S. Pat. No. 3,696,459.

DESCRIPTION OF A PREFERRED EMBODIMENT OF THE INVENTION

Figure 2:
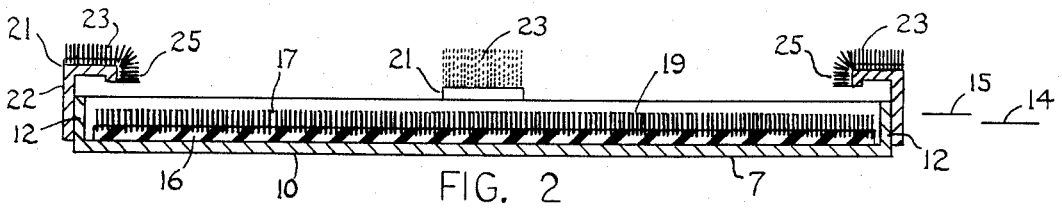
FIG. 2 is a sectional view taken on line 2—2 in FIG. 1.
Figure 1:
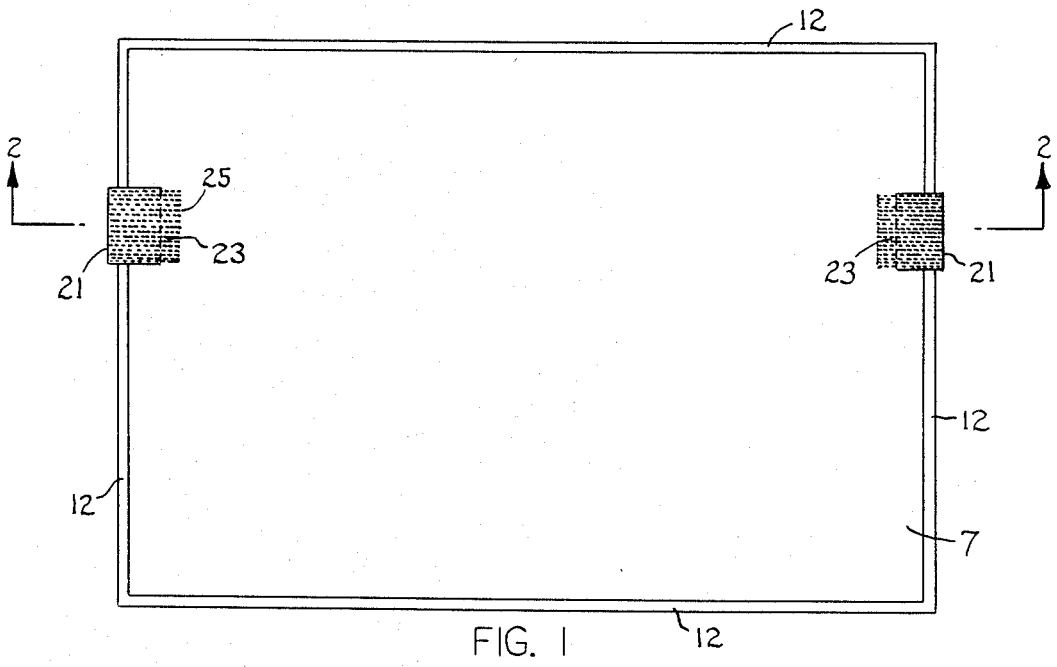
FIG. 1 is a top plan view of a shoe sole cleaner device embodying our invention.
Figure 3:
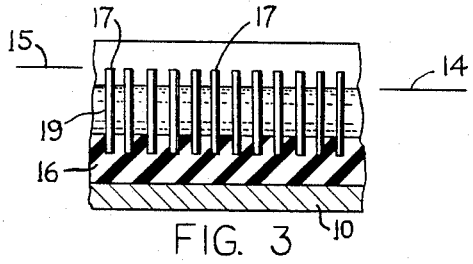
FIG. 3 is a fragmentary enlarged view of the FIG. 1 embodiment taken in the same direction as FIG. 2.

FIGS. 1 and 2 show a shoe sole cleaner comprising a liquid containment tray 7 having a bottom wall 10 and four upstanding side walls 12. Cleaning liquid (detergent and/or sanitizing liquid) is disposed within a lower portion of the tray to a level designated by numeral 14.

A shoe sole-engagement mat structure 19 is supported on the tray bottom wall. The mat structure comprises a flexible backing sheet 16 formed of rubber or plastic material The mat structure also comprises closely spaced bristles 17 extending upwardly from sheet 16. The bristles are formed of relatively stiff plastic material, whereby the bristles bend only slightly under the weight of a person's shoe. Each bristle 17 has a lower end portion embedded in backing sheet 16, whereby each bristle assumes a vertical position in tray 7. Each bristle has a preferred length of a about three quarter inch. The bristles are closely spaced, e.g. on the order of 0.03 inch or less. The bristle upper edges define a plane 15 located a slight distance above liquid level plane 14.

In use of the device, a person stands on mat structure 19 with both shoes on the bristle surface. He/she shifts the shoe(s) back and forth on the bristle upper edges. The person's weight cause the bristles to buckle slightly. Also, the sliding frictional action of the shoe soles on the bristle upper edges causes the bristles to bend somewhat. As a result of these actions the bottom surface of the shoe sole comes into contact with the cleaning liquid. The bristle edges scrape against the wetted shoe sole surface to remove soil from the shoe surface.

In the event that the bottom surface of the shoe sole is not wetted by the cleaning liquid additional liquid can be poured into tray 7 to move liquid level 14 closer to bristle end plane 15.

Auxiliary shoe cleaner components 21 may be affixed to selected ones of the tray side walls to supplement the cleaning action of mat structure 19. Each auxiliary cleaner component comprises an L-shaped bracket 22 having its upper surface and inner side surface covered with a carpet material 23.

Carpet material 23 provides a vertical cleaner side face 25 that can be engaged by an edge surface of a shoe sole that might not be easily engaged by aforementioned bristles 17. The upwardly facing surface of carpet material 23 can be used to dry the bottom surfaces of the shoe soles after they have been cleaned by bristles 17.

The illustrated device can utilize a relatively shallow tray 7; a tray height on the order of one or two inches is contemplated. The shallowness of the tray is advantageous in that the tray can be placed in a walk area (e.g. a doorway) without danger of a person tripping over it. The shallow tray structure does not require the user to lift his/her foot a great distance in order to effect a shoe cleaning operation.

Mat structure 19 is sufficiently flexible that it can be slid into (or out of) tray 7 underneath the auxiliary cleaner components 21. The mat structure may be removed from tray 7 (by a slide-out motion) when it is necessary to empty the tray of accumulated soil (sludge).

The drawing shows one form that the invention can take. Other forms are possible.

I claim:

1. A shoe sole cleaner device comprising a liquid containment tray having a bottom wall; cleaning liquid filling the lower portion of the tray; a mat resting on the tray bottom wall within the liquid; said mat comprising a backing sheet and closely spaced bristles extending upwardly therefrom so that the upper ends of the bristles are slightly above the surface of the cleaning liquid; and at least one auxiliary shoe cleaner component affixed to the tray; each said auxiliary cleaner component having an upwardly facing cleaner surface for drying the bottom surface of a shoe sole and a vertical cleaner surface for engaging an edge surface of a shoe sole.

2. The cleaner device of claim 1 wherein each said vertical cleaner surface faces the tray interior space.

3. The cleaner device of claim 2 wherein each upwardly facing cleaner surface is comprised of a carpet material.

* * * * *